US007695207B1

(12) United States Patent
Laghi

(10) Patent No.: US 7,695,207 B1
(45) Date of Patent: Apr. 13, 2010

(54) SHAVING CREAM APPLICATOR

(75) Inventor: Aldo A. Laghi, Clearwater, FL (US)

(73) Assignee: Alps South, LLC, Clearwater, FL (US)

( * ) Notice: Subject to any disclaimer, the term of this patent is extended or adjusted under 35 U.S.C. 154(b) by 1636 days.

(21) Appl. No.: 10/711,077

(22) Filed: Aug. 20, 2004

(51) Int. Cl.
*A46B 11/08* (2006.01)

(52) U.S. Cl. ..... 401/2; 401/1

(58) Field of Classification Search ..... 401/1, 401/2, 195, 52
See application file for complete search history.

(56) References Cited

U.S. PATENT DOCUMENTS

| | | | | |
|---|---|---|---|---|
| 1,242,095 | A * | 10/1917 | White | 401/1 |
| 1,772,501 | A * | 8/1930 | Shelton | 601/17 |
| 1,875,426 | A | 9/1932 | Dillon | |
| 2,132,943 | A * | 10/1938 | Frazier | 401/1 |
| 2,461,776 | A | 2/1949 | Rowan | |
| 2,756,908 | A * | 7/1956 | Miller | 222/402.13 |
| 3,116,403 | A | 12/1963 | Carter | |
| 3,388,958 | A | 6/1968 | Modla | |
| 3,644,707 | A | 2/1972 | Costello | |
| 3,752,155 | A | 8/1973 | Blinoff, Jr. et al. | |
| 3,783,511 | A | 1/1974 | Pass | |
| 3,822,434 | A | 7/1974 | Mahoney | |
| 3,823,851 | A | 7/1974 | Waters | |
| 3,843,022 | A | 10/1974 | Radcliffe et al. | |
| 3,981,597 | A | 9/1976 | Cohn | |
| 3,990,612 | A | 11/1976 | Gasser | |
| 3,997,083 | A | 12/1976 | McNair | |
| 4,067,480 | A | 1/1978 | Gasser | |
| 4,203,431 | A | 5/1980 | Abura et al. | |
| 4,636,102 | A | 1/1987 | Drake | |
| 4,682,713 | A | 7/1987 | Clapp | |
| 4,753,547 | A | 6/1988 | Dodero | |
| 5,647,841 | A | 7/1997 | Groenewold et al. | |
| 5,811,766 | A | 9/1998 | Fabrikant et al. | |
| 6,056,160 | A | 5/2000 | Carlucci et al. | |
| 6,216,911 | B1 | 4/2001 | Kreitemier et al. | |
| 6,269,821 | B1 | 8/2001 | Berke et al. | |
| 6,311,868 | B1 | 11/2001 | Krietemeier et al. | |

FOREIGN PATENT DOCUMENTS

| | | |
|---|---|---|
| EP | 0 538 528 A1 | 4/1993 |

* cited by examiner

*Primary Examiner*—David J Walczak
(74) *Attorney, Agent, or Firm*—Henry J. Recla

(57) ABSTRACT

A shaving gel applicator includes many different embodiments that include an annular brush, a disc-shaped brush, a plurality of circumferentially spaced apart disc-shaped brushes, a pair of straight brushes, a single straight brush, and more. Some of the brushes are mounted for rotary motion and some for reciprocation in a linear motion. Heat is applied to the brushes to heat shaving gel deposited on the brushes. The shaving gel is dispensed from a cartridge that is releasably engaged to the applicator. A detector detects the type of cartridge in use and adjusts the amount of heat to be applied and the brush rotation or reciprocation speed that optimizes the performance of the shaving gel in that cartridge. In alternative embodiments, the gel is heated in a gel pack before it is dispensed onto the brushes.

16 Claims, 19 Drawing Sheets

SHAVING CREAM APPLICATOR

FIELD OF THE INVENTION

This invention relates to shaving gel applicators. More particularly, it relates to an applicator that heats shaving gel or gel before it is applied to skin.

DESCRIPTION OF THE PRIOR ART

Compounds that soften hair or whiskers prior to shaving are typically provided in the form of shaving gel, foam, gel, or the like. For convenience, all of such compounds are hereinafter referred to as shaving gel.

The shaving gels in common use are typically applied to skin at room temperature by hand or brush. Some dispensers heat the shaving gel before it is applied, but this requires having to wait a long time before the container is heated to the required temperature. Also with some containers that are pressurized, heating the container can be a safety hazard. There are also available heaters that heat the shaving cream as it is dispensed from the container. These consist of heated tubes that the cream travels through from the pressurized container. These though do not perform properly as there is a fundamental problem of insufficient surface and insufficient time to heat the shaving cream.

The heated tube geometry is limited by the necessity of having the shaving cream travel through it a reasonable velocity in order to dispense enough shaving cream in a reasonable time. Therefore the tube cannot be too small nor too long. Being relatively large the tube does not provide a sufficient surface to volume ratio and being relatively short the tube does not provide an adequate residence time for the shaving cream to heat up appropriately.

Human hair is seen as quite rough when observed through a microscope. Even a sharp razor cannot satisfactorily cut through a dry beard or other dry collection of hair. Wetting the beard or hair softens the beard or hair at least to some extent but the application of a shaving gel especially formulated for that purpose is needed in most cases. Thus, a shaving gel typically includes a surfactant to reduce surface tension of liquid on the skin so that it better wets the beard. Means for reducing the viscosity of the liquid is also commonly provided for the same reason. Mechanical devices that force the shaving gel into the spaces between the hair follicles are also well known.

However, application of shaving gel by hand or brush results in less-than-optimal contact between the shaving gel and the beard or hair. If the viscosity of the shaving gel is too high, it runs off the skin quickly without adequately softening the beard or hair. The shaving gel must therefore have a certain degree of thixothropicity to stay put on the skin after application. However, if the viscosity is too high, normally the surface tension is high as well and the beard or hair is not adequately wetted. High viscosity causes poor wetting due to insufficient surface contact of the shaving gel with the hair.

If shaving gel is heated to reduce its thixothropicity or viscosity prior to placing it on a hand or brush, however, it becomes difficult to apply to the beard. It leaks through the fingers or the brush bristles and is messy to deal with.

What is needed, then, is an apparatus for applying shaving gel that results in the beard or hair being thoroughly wetted prior to shaving so that the shaving procedure results in a smooth, very close shave.

The apparatus should provide a heated shaving gel that is not messy when applied.

However, in view of the prior art taken as a whole at the time the present invention was made, it was not obvious to those of ordinary skill how the identified needs could be fulfilled.

SUMMARY OF THE INVENTION

The long-standing but heretofore unfulfilled need for an improved shaving gel applicator is now met by a new, useful, and non-obvious invention. In a first embodiment of the invention, at least one gel-applying device such as a brush, sponge, cloth, or other suitable substrate for supporting shaving gel, hereinafter referred to as a brush for convenience, is adapted to introduce shaving gel onto hair or whiskers to be shaved. A heater is integrated with the at least one brush so that the heater is in direct thermal communication with the brush. Thus, while the shaving gel is resident on the bristles the heater continues to add thermal energy to the shaving gel. An advantage to this configuration is that a user of the apparatus has far more control in heating the shaving gel to a desired temperature as distinguished from devices that preheat the shaving gel prior to introduction onto the brush. Still another advantage of this configuration is that less heating surface and/or heating elements are required in the device as the heater applies energy to shaving gel where it is likely to remain the longest, namely on the brush or even indirectly to the hair as the heated shaving gel and brush come into contact with it.

A mechanical drive means includes a power source and a motor electrically coupled to the power source and to the at least one brush to rotate or oscillate the at least one brush during application of shaving gel. The power source may also be electrically coupled to the heater.

In one embodiment the at least one brush rotates or oscillates and the heater is stationary relative to the motor.

In another embodiment the heater and the at least one brush rotate relative to the motor and the heater and the power source are electrically coupled by a rotating brush contact connection.

Another embodiment includes a cartridge holder adapted to receive a shaving gel cartridge. The cartridge holder is adapted to slideably or screw-threadably receive the shaving gel cartridge. The cartridge holder further includes at least one detector means for detecting the type of shaving gel cartridge received in the cartridge holder and adjusting the temperature of the heater and/or the rotational or oscillating speed or torque generated by the motor responsive thereto. The detector means may include mechanical, electrical, digital or wireless connection to the mechanical drive means to communicate the shaving gel type information from the cartridge.

DETAILED DESCRIPTION OF THE PREFERRED EMBODIMENT

Figure 1A:
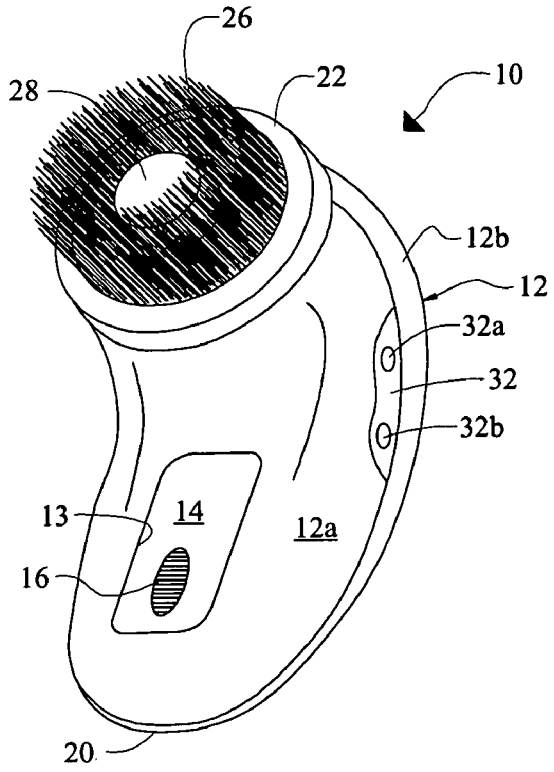
FIG. 1A is a perspective view of a first embodiment of the invention.

Referring now to FIGS. 1A. 1B, and 1C, it will there be seen that a first embodiment of the invention is denoted as a whole by the reference numeral 10.

Figure 1B:
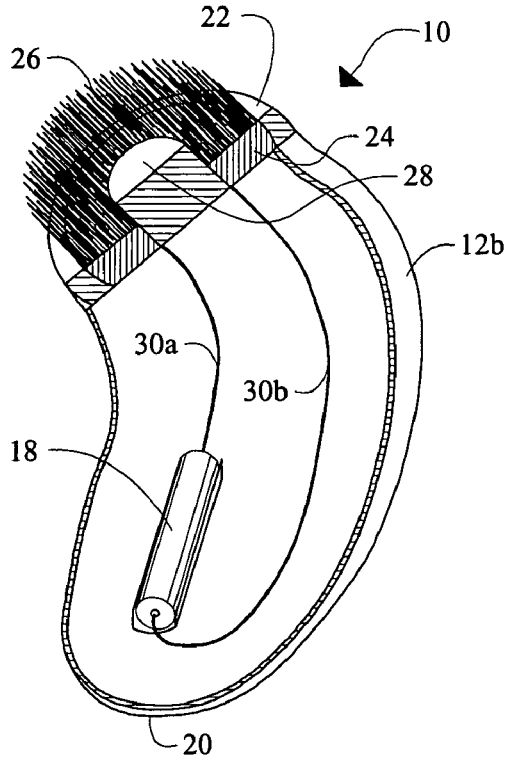
FIG. 1B is a perspective view of said first embodiment with a half shell of the main body thereof removed.

Shaving gel applicator 10 includes a main body 12 that is gripped by a user. In this particular example, main body 12 is formed of two half shells 12*a* and 12*b*. FIG. 1B depicts the structure of FIG. 1A when half shell 12*a* is removed to expose the interior of said main body.

Main body half shell 12*a* has an opening 13 formed therein that is covered by removable battery cover 14 having recessed and roughened gripping surface 16 formed therein to facilitate manual removal and reinstallation of battery cover 14. Battery 18 is positioned in the hollow interior of main body as depicted in FIG. 1B.

Half shells 12*a* and 12*b* are configured to meet at trailing end 20 of applicator 10 and to form a circular opening at the opposite or leading end thereof. Annular collar 22 circumscribes said opening.

Annular brush base 24 is positioned radially inwardly relative to annular collar 22 and is disposed in abutting relation therewith. Annular brush base 24 could be integrally formed with annular collar 22 but in this preferred embodiment the parts are formed separately from one another to enable replacement of said brush base as needed.

An annular brush 26 is mounted along the circumference of brush base 22. Brush 26 may be formed by a plurality of bristles, by a sponge material, by a cloth material, or by any other material suitable for forming a substrate upon which shaving gel may be deposited. For convenience, all such materials are hereinafter referred to as brushes.

Figure 2:
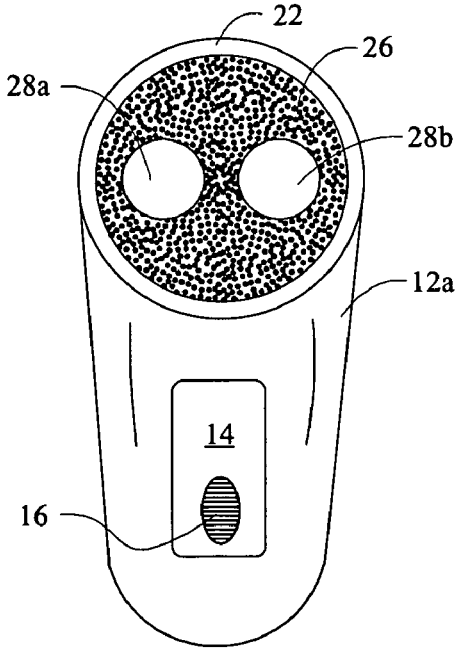
FIG. 2 is a top plan view of a second embodiment.

Heater means 28 is positioned in surrounded relation to said bristles 26. It is preferably a resistance-element heater and draws current from battery 18 from electrical conductors 30*a* and 30*b* (FIG. 2). Switch actuator 32 includes "on" switch actuator 32*a* and "off" switch actuator 32*b* that respectively complete and open the circuit between battery 18 and heater means 28.

In this first embodiment, brush base 24, brush 26, and heater means 28 are mounted in a fixed position and do not rotate. Moreover, this first embodiment includes no means for delivering a shaving gel to brush 26 other than the conventional way of manually applying such gel to said brush.

However, the provision of battery 18 and centrally-mounted heater means 28 advances the art because said heater means, when activated, increases the temperature and thus the effectiveness of the shaving gel applied to brush 26. The heat produced by centrally-mounted heater means 28 radiates outwardly in all directions and thus heats all of the brush and any shaving gel applied thereto. Brush 26 has a relatively low coefficient of heat transfer and the moist shaving gel applied thereto will have a higher coefficient of heat transfer, thereby ensuring that the generated heat will be efficiently used in heating said shaving gel. The heated shaving gel warms up the beard or other hair to which it is applied, softening said beard or hair and rendering it easier to cut cleanly by a shaving device, not shown.

A second embodiment is depicted in FIG. 2. This embodiment has essentially the same structure as the first embodiment with the exception that two (2) heating means 28*a* and 28*b* are provided in diametrically opposed relation to one another. This arrangement reduces the time required to warm the shaving gel.

Figure 3A:
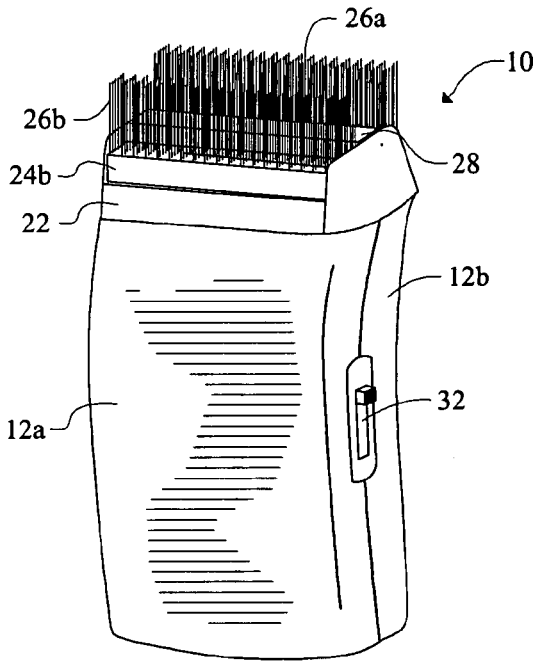
FIG. 3A is a perspective view of a third embodiment.
Figure 3B:
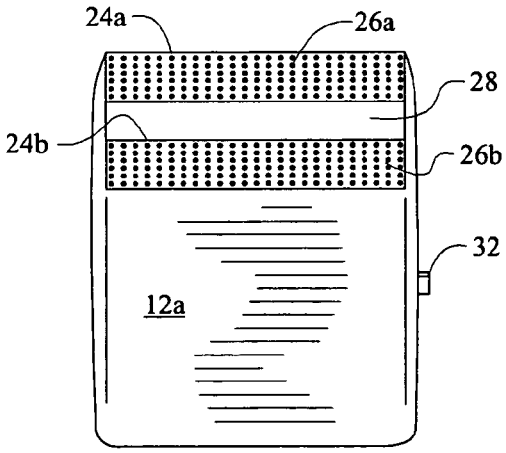
FIG. 3B is a top plan view of said third embodiment.

A third embodiment is depicted in FIGS. 3A and 3B. In this embodiment, half shells 12*a*, 12*b* collectively form a hollow parallelepiped housing. Collar 22 thus has a rectangular configuration. Battery cover 14 and battery 18 are not depicted in these views and switch actuator 32 is depicted in a different form but the operation of this embodiment is much like that of the first two embodiments. Instead of one annular brush base 24, there are two (2) straight brush bases 24*a*, 24*b* and brushes 26*a*, 26*b* are respectively mounted thereon. Heater means 28 is also of straight configuration and is positioned in sandwiched relation between said two rows of brushes so that the rows are quickly and evenly heated. Brushes 26*a*, 26*b* neither rotate nor oscillate. The shaving gel is applied manually to said brushes in a conventional way.

Figure 4A:
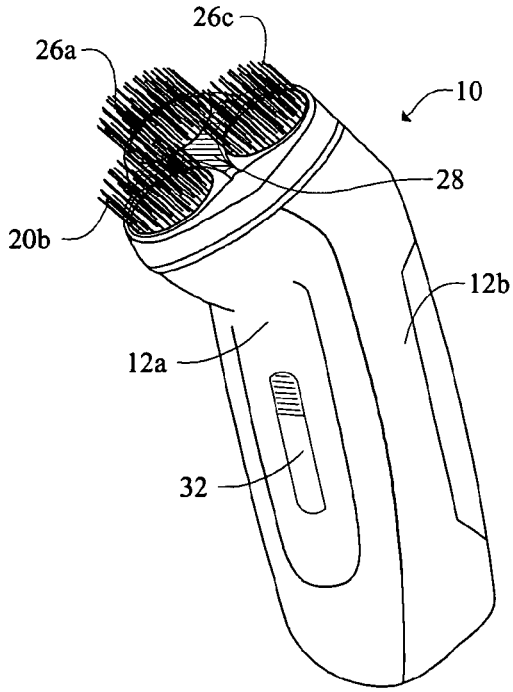
FIG. 4A is a perspective view of a fourth embodiment.
Figure 4B:
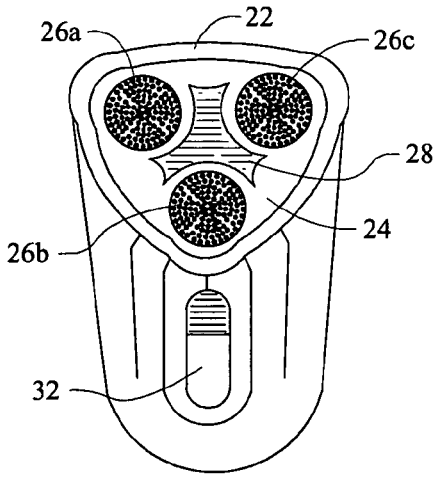
FIG. 4B is a top plan view of said fourth embodiment.

Embodiment number four (4) is depicted in FIGS. 4A and 4B. Again, battery cover 14 and battery 18 are not depicted and switch actuator 32 is depicted in yet another form, there being a very large number of known switch actuators. Brushes 26 in this fourth embodiment are provided in three circular formations denoted 26*a*, 26*b*, and 26*c* and said formations are mounted in a common brush base 24.

Heater means 28 has a generally "Y"-shaped configuration and is positioned centrally of brushes 26*a*, 26*b*, 26*c* to ensure equal heat distribution therebetween. As in the first three (3) embodiments, brushes 26*a*, 26*b*, and 26*c* of this embodiment do not rotate and shaving gel is manually applied thereto.

Figure 1C:
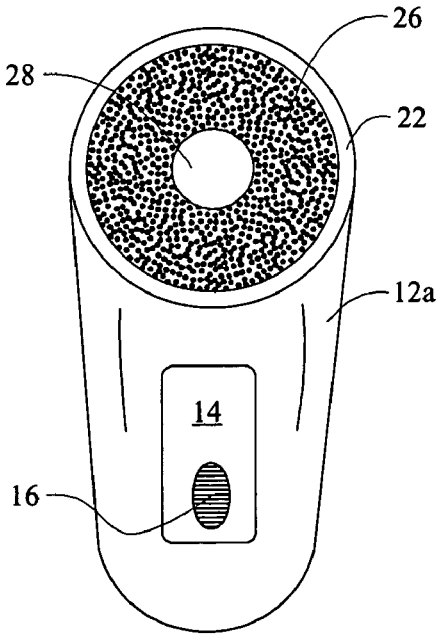
FIG. 1C is a top plan view of said first embodiment.

The fifth embodiment is depicted in FIGS. 5A-E. It has a structure substantially identical to that of the first embodiment (FIGS. 1A, 1B, and 1C) but further includes cartridge 34 within which is stored shaving gel. Cartridge 34 is releasably mounted in a cartridge holder within the hollow interior of hollow base 12 in spaced apart relation from battery 18. The content 36 of cartridge 34 is in fluid communication with a pair of diametrically opposed gel-application openings 40*a*, 40*b* by means of elongate conduit 38. More particularly, conduit 38 is in direct fluid communication with gel-application opening 40*a*. A semicircular bore, not depicted, is formed in brush base 24 and interconnects opening 40*a* and opening 40*b* to one another and thus provides fluid communication between cartridge 34 and bore 40*b*.

Brush base 24, 26, and heater means are not rotatably mounted in this embodiment.

Figure 5A:
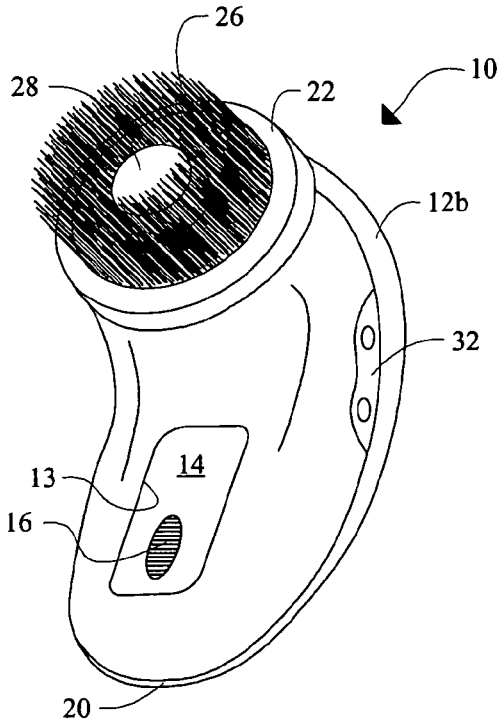
FIG. 5A is a perspective view of a fifth embodiment.
Figure 5B:
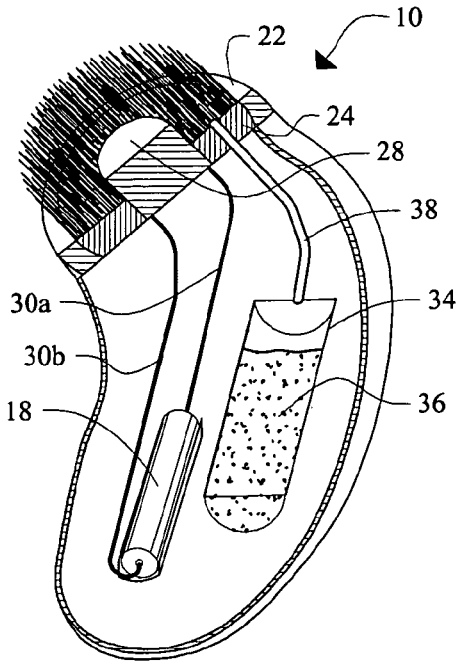
FIG. 5B is a perspective view of said fifth embodiment with a half shell of the main body thereof removed.

FIG. 5B depicts cartridge 34 in the hollow interior of applicator 10, accessible only be separating half shell 12*a* from half shell 12*b*.

Figure 5C:
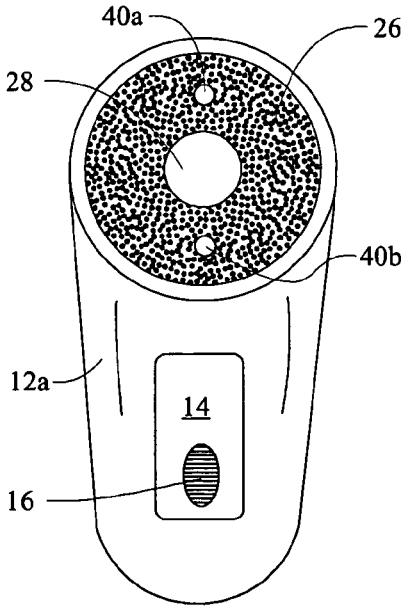
FIG. 5C is a top plan view of said fifth embodiment.
Figure 5D:
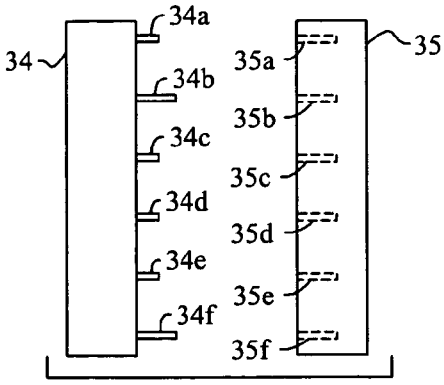
FIG. 5D is an exploded side view of a cartridge and cartridge holder of said fifth embodiment.

However, in a contemplated commercial embodiment of the invention, depicted diagrammatically in FIG. 5D, cartridge 34 is accessible without requiring the separation of such half shells. More particularly, cartridge holder 35 is positioned in a recess formed in half shell 12*a*, half shell 12*b* (as depicted in FIG. 5E), or both.

Since many different types of shaving creams, gels, or foams may be dispensed by cartridge 34, it is advantageous to provide a cartridge and a cartridge holder that are constructed so that the type of cartridge is identified when it is positioned into the cartridge holder.

For example, a gel having a low viscosity may require more heating than a gel having a high viscosity. Moreover, a higher brush rotation speed may be required as well. On the other hand, a lower brush rotation speed may be required.

Figure 5E:
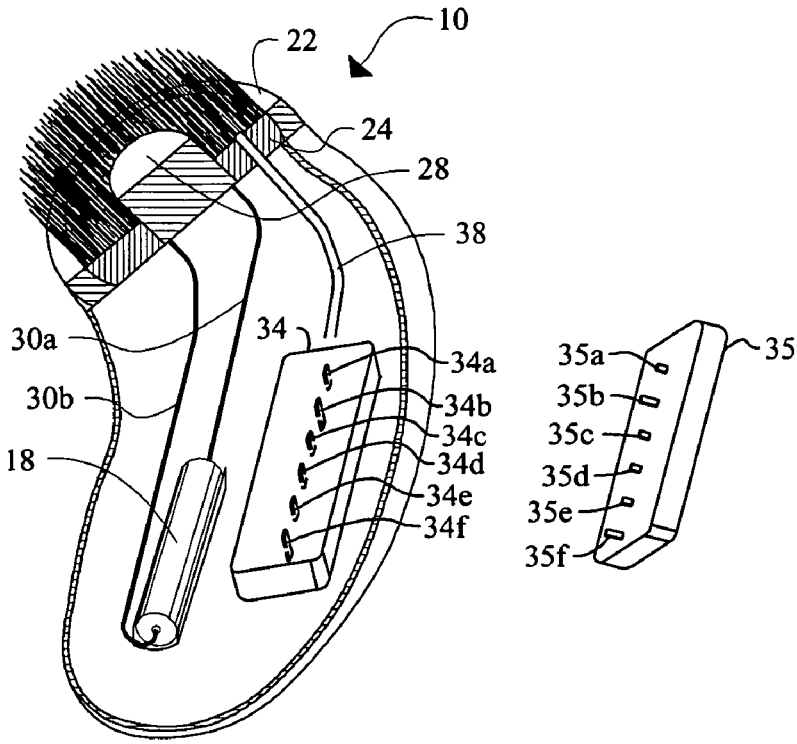
FIG. 5E is an exploded perspective view of the fifth embodiment.

Although there are numerous ways of distinguishing between various cartridges, FIGS. 5D and 5E depict an exemplary cartridge 34 having six (6) electrical contacts, denoted 34*a-f*, protruding therefrom. Cartridge holder 35 has six (6) electrical sockets, denoted 35*a-f*, disposed in alignment with said electrical contacts. In this particular example, contact 34*b* protrudes outwardly to a greater extent than contacts 34*a* and 34*c*. Moreover, contact 35*f* protrudes more than contacts 35*d* and 35*e*. Contacts 34*a-c* are dedicated to identifying the temperature to which the gel within the associated cartridge should be heated and contacts 34*d-f* are dedicated to identifying the rotational speed at which the brush or brushes should be rotated for the gel contained within that cartridge. Therefore, in this example, the gel will be heated to a medium temperature of three possible temperatures and the brush or brushes will rotate at the fastest rotational speed of three possible rotational speeds.

Cartridges containing gels of differing properties would thus have electrical contacts 34*a-f* of differing patterns. The disclosure of three (3) temperature settings (low, medium, and high) and three (3) rotational speeds (slow, medium, and fast) is for illustrative purposes only. The number of settings for each quality may be reduced or increased.

Moreover, the use of contacts and sockets for receiving those contacts is also provided for illustrative purposes only. In view of this disclosure, a machine designer could develop a large plurality of differing structures to identify a cartridge and to adjust the amount of heat supplied and the rotational speed of the brush or brushes based upon the identification.

As an additional example, all of the contacts could have a common length, unlike the example of FIG. 5D, and be spring-loaded. Differing combinations of sockets formed in the cartridge holder could be employed, with some sockets being plugged. A spring-loaded contact would thus retract into the cartridge upon encountering a closed socket so that only the unplugged sockets could admit the contacts.

Nor is there a requirement that the functions of heating gel and controlling the rotational speed of the brushes be divided between the contacts and sockets. For example, if the cartridge and holder are constructed such that only one contact may enter into only one socket, that particular combination could generate a signal that activates a heater to its lowest temperature and the speed of the brush or brushes to the lowest rotational speed available. Two contacts received in two sockets might indicate that the heater should be activated to generate its second highest level of heat and that the brush or brushes should rotate at their slowest rotational speed, and so on.

Nor is the invention limited to protruding contacts and sockets that accept them. Numerous other interlocks or detectors are available, including other electromechanical detectors, digital detectors, wireless detectors, and the like.

Figure 6:
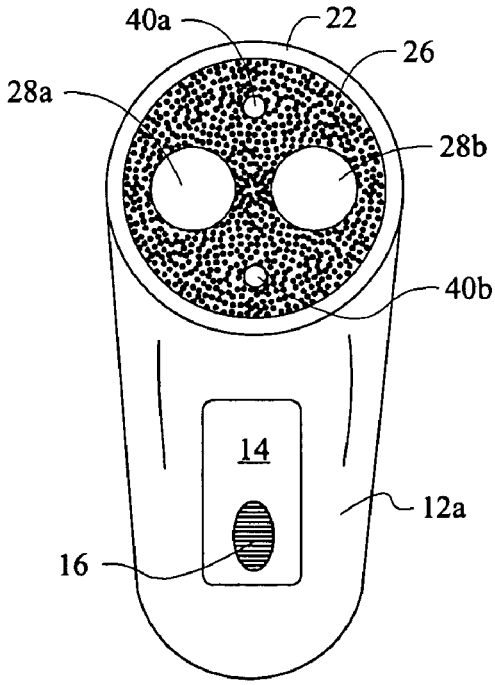
FIG. 6 is a top plan view of a sixth embodiment.

FIG. 6 depicts the sixth embodiment of the invention. It differs from the fifth embodiment only by having a pair of laterally spaced apart heater means 28*a*, 28*b*. It differs from the second embodiment of FIG. 2 because it includes canister 34, conduit 38, and gel-application openings 40*a*, 40*b*.

Figure 7A:
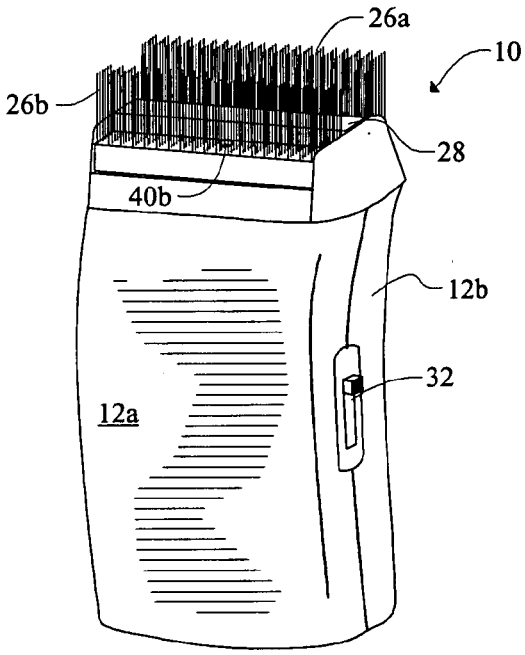
FIG. 7A is a perspective view of a seventh embodiment.
Figure 7B:
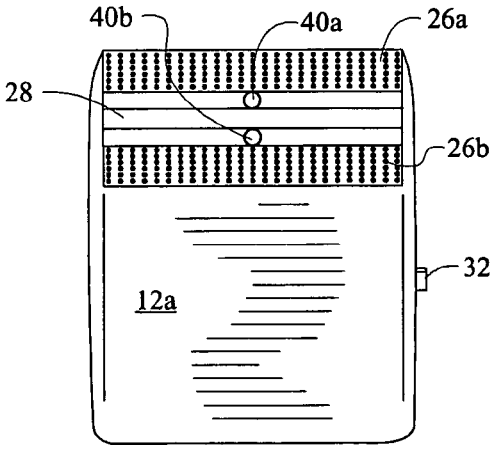
FIG. 7B is a top plan view of said seventh embodiment.

Similarly, the seventh embodiment of FIGS. 7A and 7B differs from the third embodiment of FIGS. 3A and 3B only by the addition of said canister 34, conduit 38 (not depicted in FIGS. 7A and 7B), and gel-application openings 40*a*, 40*b*.

Figure 8A:
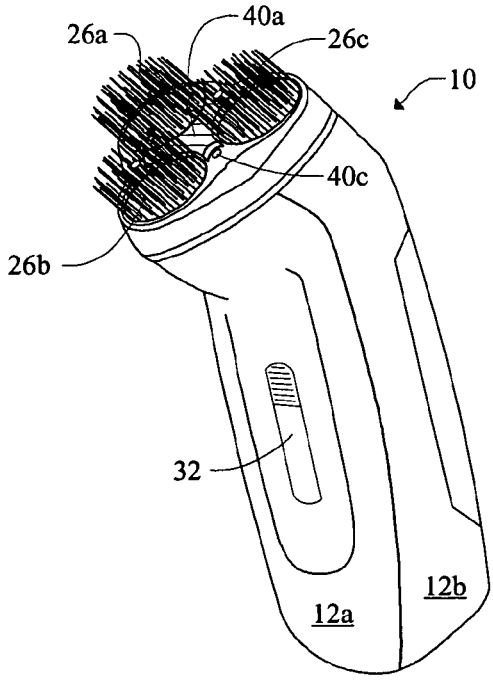
FIG. 8A is a perspective view of an eighth embodiment.
Figure 8B:
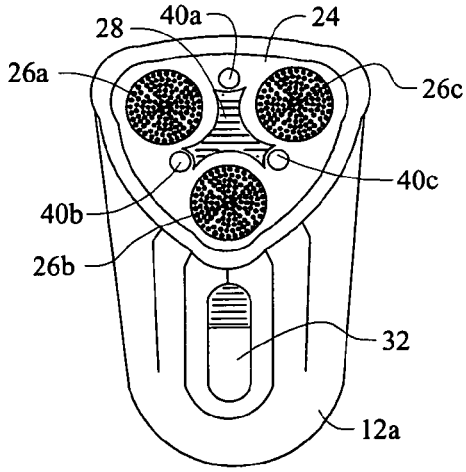
FIG. 8B is a top plan view of said eighth embodiment.

The eighth embodiment of FIGS. 8A and 8B differs from the fourth embodiment of FIGS. 4A and 4B only by the addition of said canister 34, conduit 38 (not depicted in FIGS. 7A and 7B), and gel-application openings 40*a*, 40*b*, and 40*c*. Said openings 40*a*, 40*b*, and 40*c* are interconnected to one another by an annular bore formed in brush base 24.

Figure 9A:
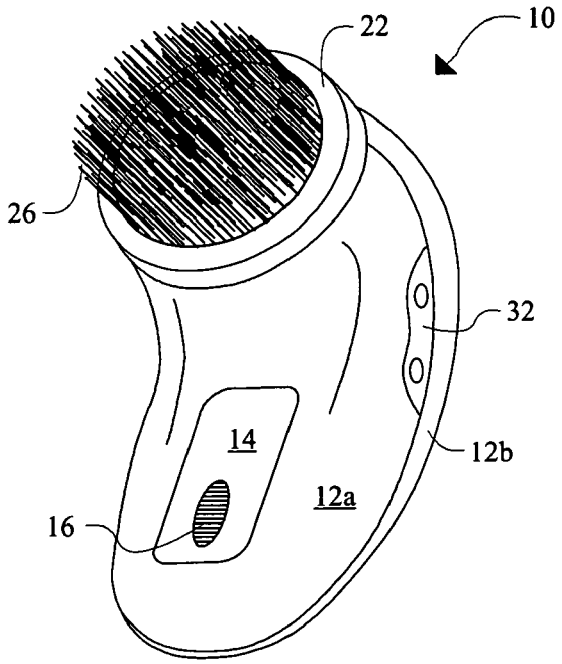
FIG. 9A is a perspective view of a ninth embodiment.
Figure 9B:
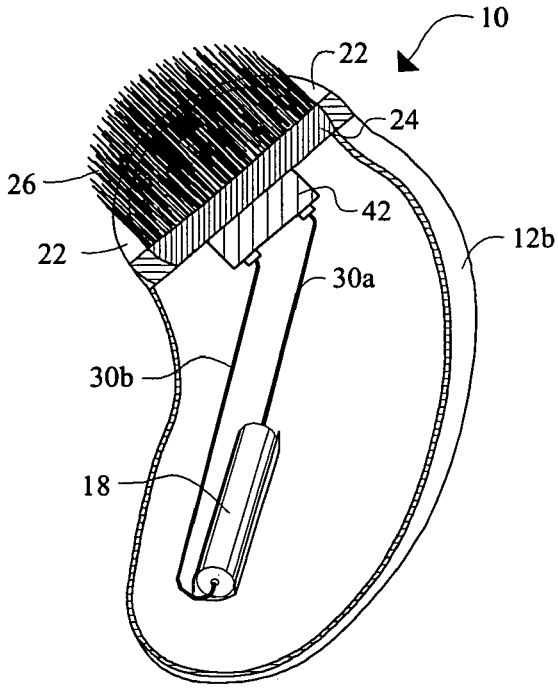
FIG. 9B is a perspective view of said ninth embodiment with a half shell of the main body thereof removed.
Figure 9C:
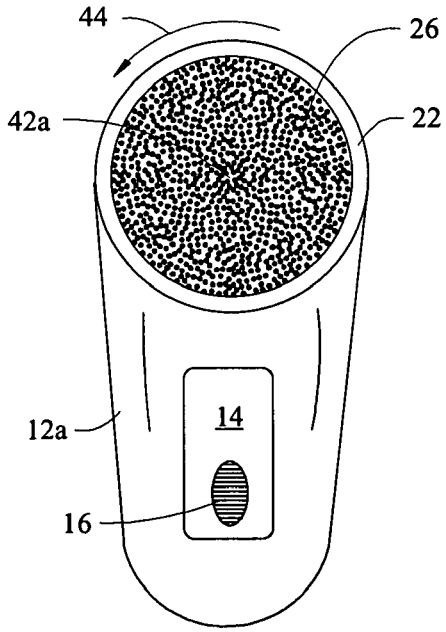
FIG. 9C is a top plan view of said ninth embodiment.

A ninth embodiment is depicted in FIGS. 9A, 9B, and 9C. This embodiment differs from the first embodiment of FIGS. 1A, 1B, and 1C in that it includes no heater means and it differs from the fifth embodiment of FIGS. 5A and 5B in that it has no gel-application means. It differs further from said first and fifth embodiments in that brush 26 has a disc-shaped configuration, there being no heater means as aforesaid. This ninth embodiment further differs from the aforesaid embodiments in that brush base 24 and bristles 26 mounted thereon are rotatably mounted. Thus, even though the shaving gel is unheated, its application is more thorough than the prior art manual method because the rotating action massages the shaving gel into the skin and the beard or other hair to be shaved.

More particularly, DC motor means 42 is in electrical communication with battery 18 via conductors 30*a*, 30*b*. Motor means 42 has output shaft 42*a* to which brush base 24 is secured for conjoint rotation therewith. Such rotation is indicated by arcuate directional arrow 44 in FIG. 9C. An AC motor means is also within the scope of this invention.

Figure 10A:
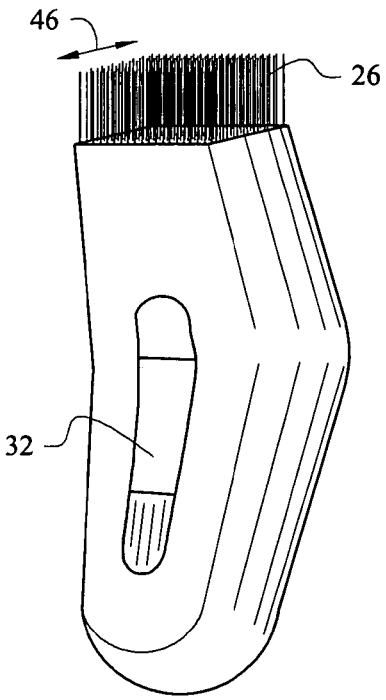
FIG. 10A is a perspective view of a tenth embodiment.
Figure 19A:
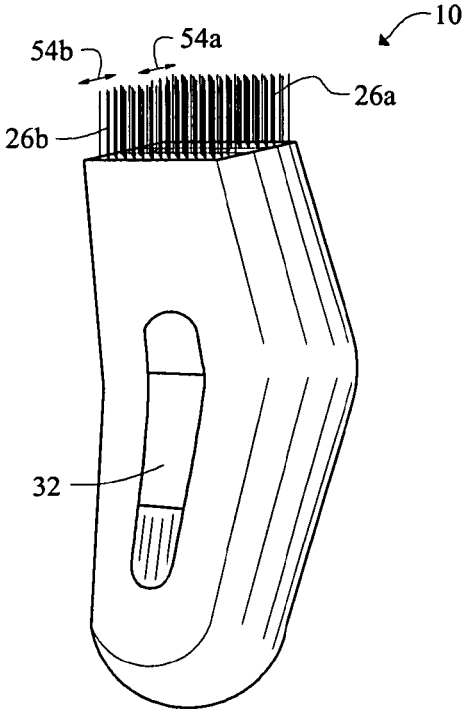
FIG. 19A is a perspective view of a nineteenth embodiment.
Figure 19B:
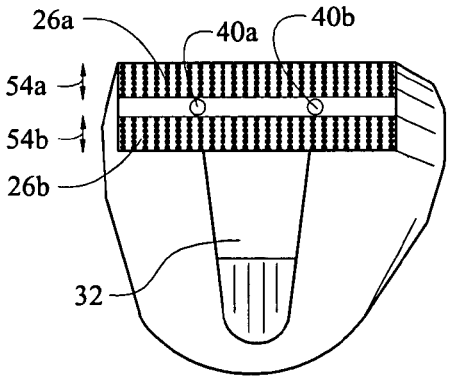
FIG. 19B is a top plan view of said nineteenth embodiment.

The tenth embodiment, depicted in FIGS. 10A and 19B, differs from the ninth embodiment in that brush base 24 and hence bristles 26 are formed into a square or rectangular configuration and said brush base and bristles are adapted to reciprocate rather than rotate, as indicated by double-headed directional arrow 46 in said FIGS. A suitable linkage, not shown, translates the rotational motion of output shaft 42*a* into a linear reciprocation motion.

Figure 11A:
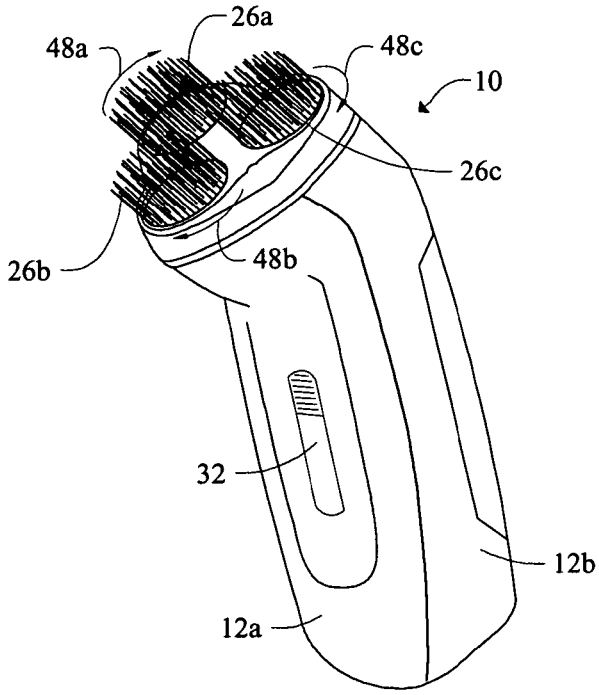
FIG. 11A is a perspective view of an eleventh embodiment.
Figure 11B:
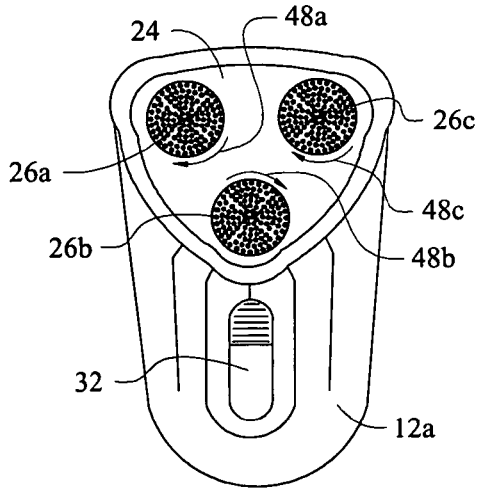
FIG. 11B is a top plan view of said eleventh embodiment.

The eleventh embodiment of FIGS. 11A and 11B differs from the fourth embodiment of FIGS. 4A and 4B because it lacks the heater means of the fourth embodiment but it includes rotatably mounted bristles 26*a*, 26*b*, and 26*c*, all connected to the output shaft of motor means 42, not depicted in FIGS. 11A and 11B, by a suitable gear arrangement such as a sun gear mounted on said output shaft that meshingly engages planet gears affixed to respective axles that carry brush bases 24*a*, 24*b*, and 24*c*, not depicted.

Figure 12A:
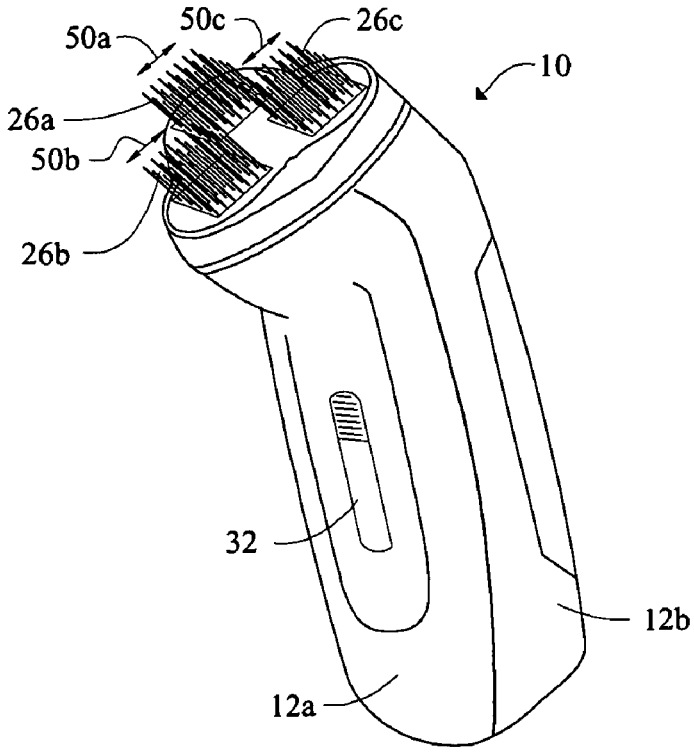
FIG. 12A is a perspective view of a twelfth embodiment.
Figure 12B:
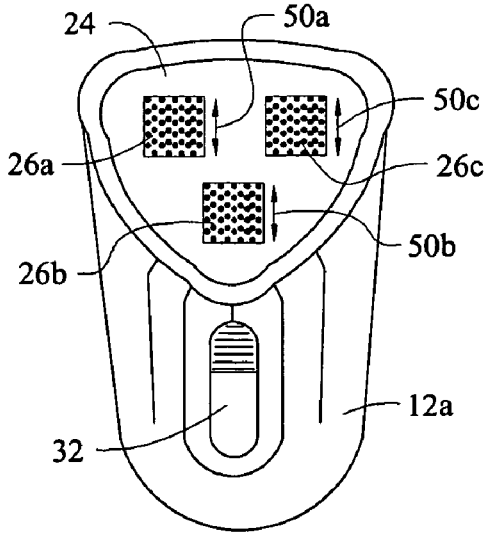
FIG. 12B is a top plan view of said twelfth embodiment.

The twelfth embodiment of FIGS. 12A and 12B is similar to the eleventh embodiment and differs only to the extent that the bristles of brushes 26*a*, 26*b*, and 26*c* are arranged into a square pattern to form square brushes and said square brushes are adapted to reciprocate rather than rotate. The reciprocation is denoted by double-headed directional arrows 50*a*, 50*b*, and 50*c*.

Figure 13A:
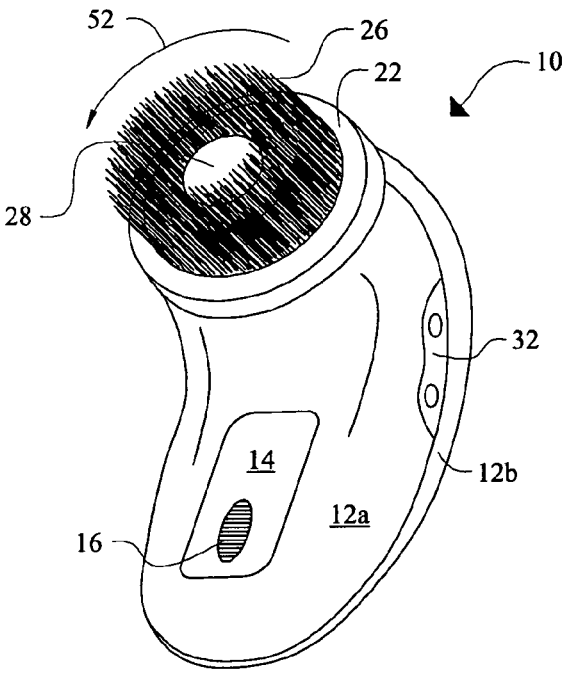
FIG. 13A is a perspective view of a thirteenth embodiment.
Figure 13B:
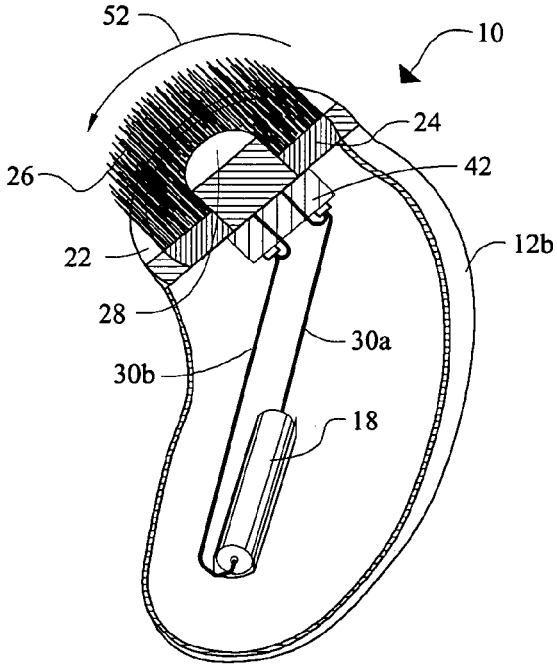
FIG. 13B is a perspective view of said thirteenth embodiment with a half shell of the main body thereof removed.
Figure 13C:
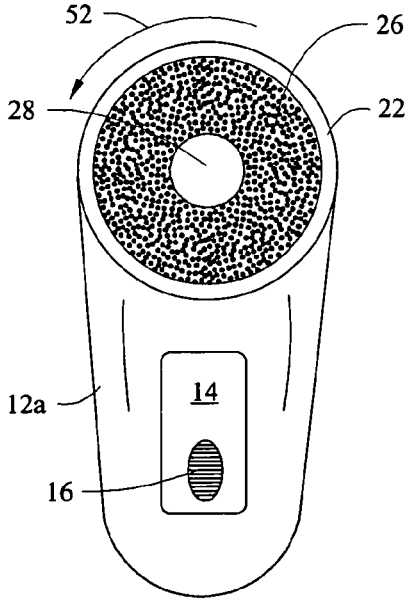
FIG. 13C is a top plan view of said thirteenth embodiment.

FIGS. 13A, 13B, and 13C depict the thirteenth embodiment. It is similar to the first embodiment (FIGS. 1A, 1B, and 1C) but differs from said first embodiment in that bristles 26 and heater means 28 are both mounted for rotation. More particularly, heater means 28 is mounted on the output shaft, not depicted, of motor means 42 for conjoint rotation therewith. Annular bristle base 24 is in press fit engagement with said heater means and therefore rotates conjointly therewith as denoted by arcuate directional arrow 53. No gel-application means is provided in this embodiment.

Figure 14A:
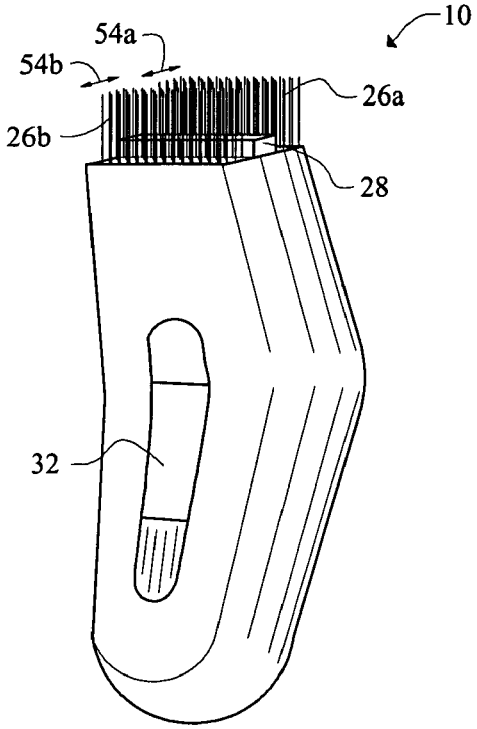
FIG. 14A is a perspective view of a fourteenth embodiment.
Figure 14B:
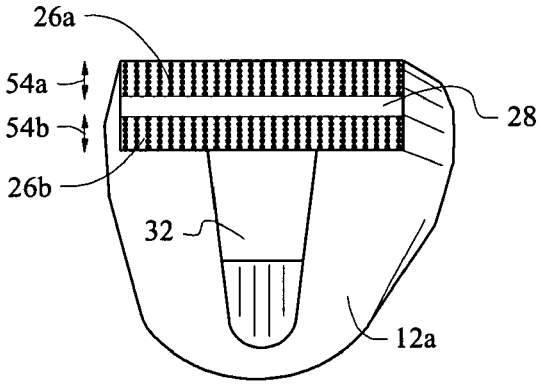
FIG. 14B is a top plan view of said fourteenth embodiment.

FIGS. 14A and 14B depict the fourteenth embodiment. It is similar to the seventh embodiment (FIGS. 7A and 7B) but differs from said seventh embodiment in that bristles 26*a*, 26*b* and heater means 28 are both mounted for reciprocation as indicated by double-headed directional arrows 54*a*, 54*b*. More particularly, the respective brush bases 24*a*, 24*b*, and heater means 28 are connected by suitable linkages, not shown, to the output shaft, not depicted, of motor means 42. No gel-application means is provided in this embodiment.

Figure 10B:
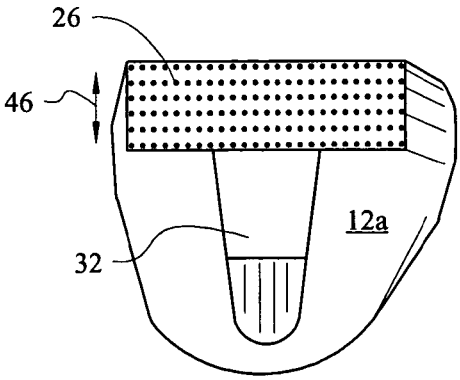
FIG. 10B is a top plan view of said tenth embodiment.
Figure 15A:
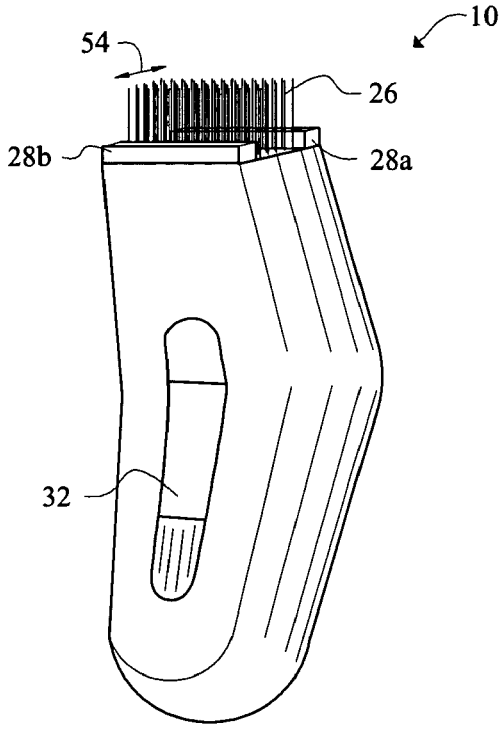
FIG. 15A is a perspective view of a fifteenth embodiment.
Figure 15B:
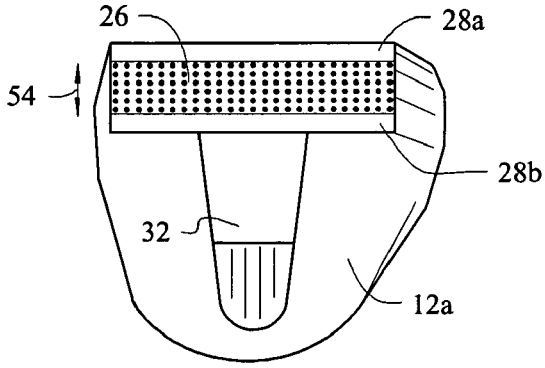
FIG. 15B is a top plan view of said fifteenth embodiment.

FIGS. 15A and 15B depict the fifteenth embodiment. It is similar to the tenth embodiment (FIGS. 10A and 10B) but differs from said tenth embodiment in that heater means 28*a*, 28*b* are provided and that said heater means and bristles 26*a*, 26*b* are mounted for reciprocation as indicated by double-headed directional arrow 54. More particularly, the respective brush bases 24*a*, 24*b*, and heater means 28 are connected by suitable linkages, not shown, to the output shaft, not depicted, of motor means 42 so that the rotary motion of said output shaft is translated into linear reciprocating motion. No gel-application means is provided in this embodiment.

Figure 16A:
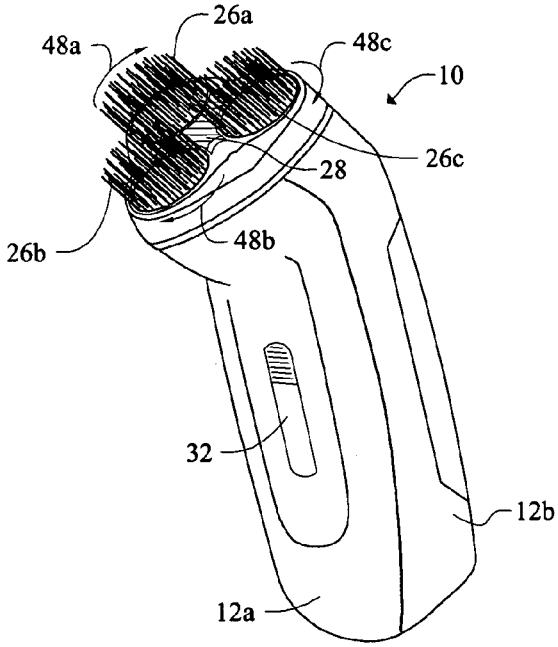
FIG. 16A is a perspective view of a sixteenth embodiment.
Figure 16B:
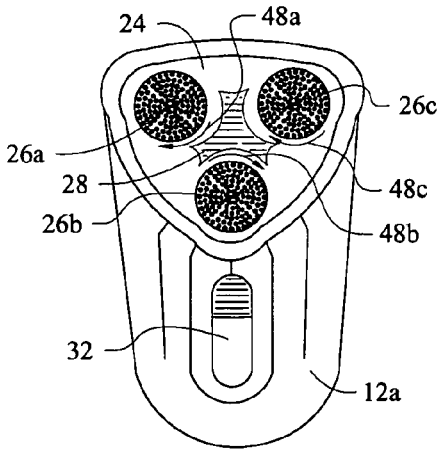
FIG. 16B is a top plan view of said sixteenth embodiment.

A sixteenth embodiment is depicted in FIGS. 16A and 16B. It differs from the eleventh embodiment of FIGS. 11A and 11B in that it adds generally "Y"-shaped heater means 28. In all other structural aspects, it is the same as said eleventh embodiment as indicated by the reference numerals common to FIGS. 16A, 16B and 11A, 11B.

Figure 17A:
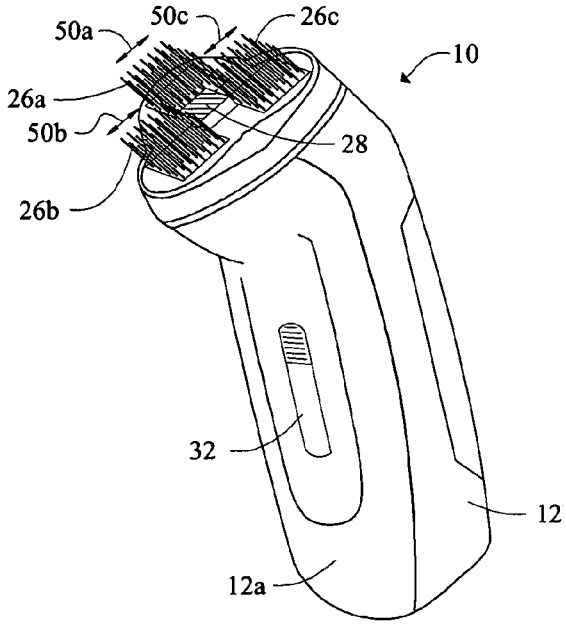
FIG. 17A is a perspective view of a seventeenth embodiment.
Figure 17B:
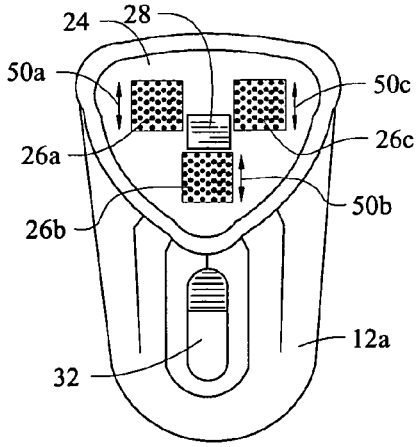
FIG. 17B is a top plan view of said seventeenth embodiment.

A seventeenth embodiment is depicted in FIGS. 17A and 17B. It differs from the twelfth embodiment of FIGS. 12A and 12B in that it adds generally square-shaped heater means 28. In all other structural aspects, it is the same as said twelfth embodiment as indicated by the reference numerals common to FIGS. 17A, 17B and 12A, 12B.

Figure 18A:
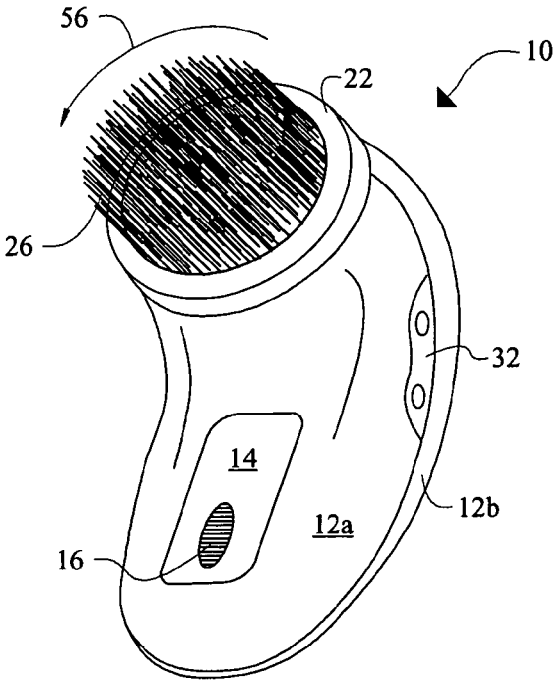
FIG. 18A is a perspective view of an eighteenth embodiment.
Figure 18B:
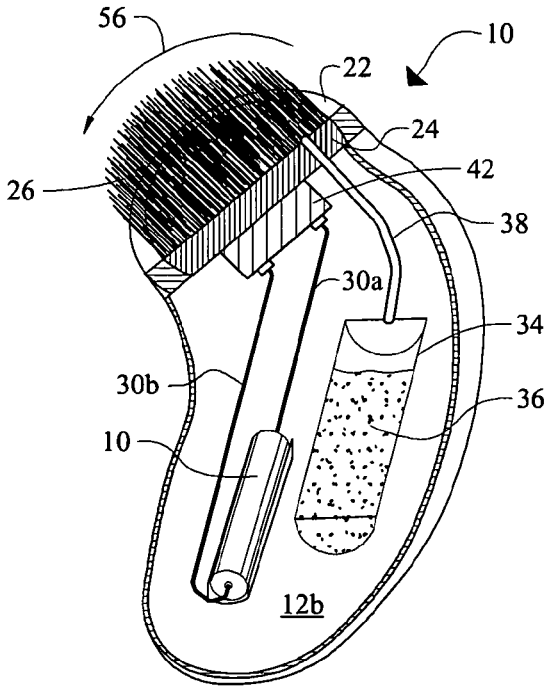
FIG. 18B is a perspective view of said eighteenth embodiment with a half shell of the main body thereof removed.
Figure 18C:
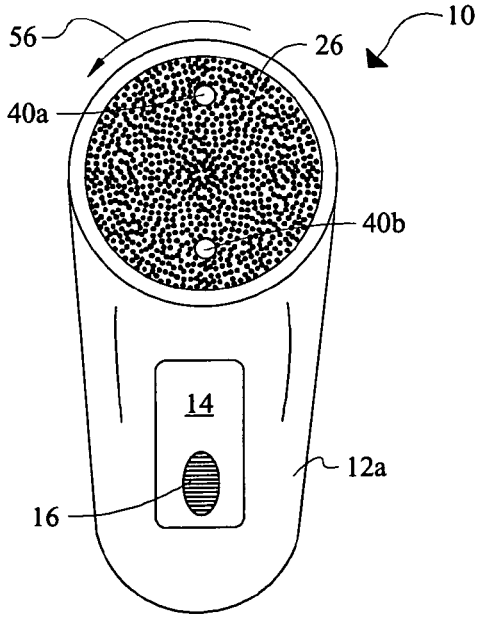
FIG. 18C is a top plan view of said eighteenth embodiment.

The embodiment of FIGS. 18A, 18B, and 18C is the eighteenth embodiment and is like the ninth embodiment (FIGS. 9A, 9B, and 9C except that said eighteenth embodiment adds gel-application cartridge 34 having contents 36. Said contents are in fluid communication via conduit 38 with gel-application openings 40*a*, 40*b* as also depicted in the fifth embodiment (FIGS. 5A, 5B, and 5C). The eighteenth embodiment includes no heater means.

The embodiment of FIGS. 19A, 19B is the nineteenth embodiment and shares a common structure with the fourteenth embodiment of FIGS. 14A, 14B except that the nineteenth embodiment includes gel-applicator 34, conduit 38, and gel-application bores 40*a*, 40*b*.

Figure 20A:
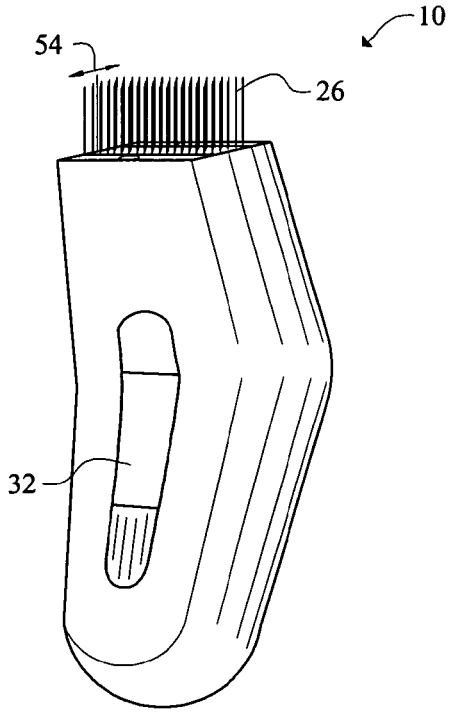
FIG. 20A is a perspective view of a twentieth embodiment.
Figure 20B:
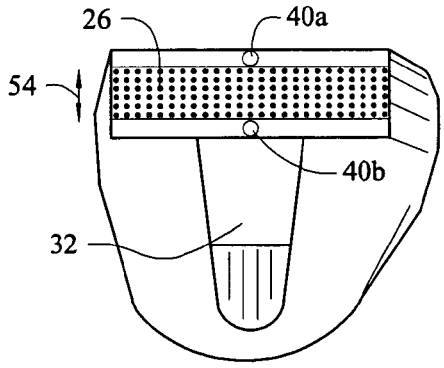
FIG. 20B is a top plan view of said twentieth embodiment.

The embodiment of FIGS. 20A, 20B is the twentieth embodiment and shares a common structure with the fifteenth embodiment of FIGS. 15A, 15B except that the twentieth embodiment includes gel-applicator 34, conduit 38, and gel-application bores 40*a*, 40*b*.

Figure 21A:
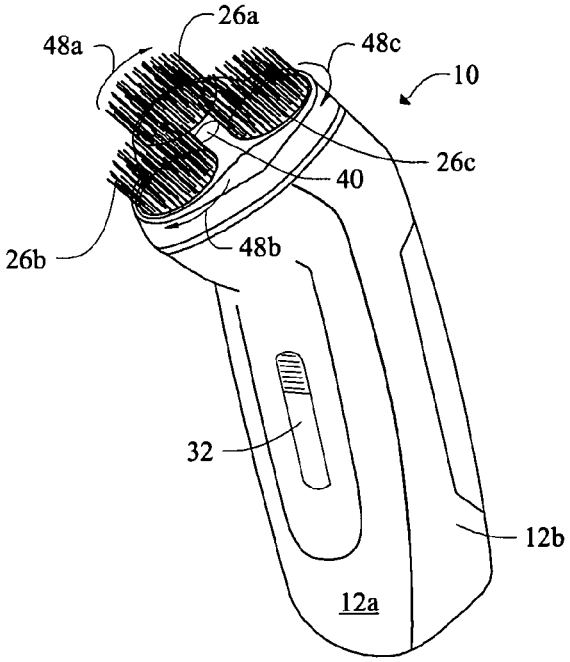
FIG. 21A is a perspective view of a twenty-first embodiment.
Figure 21B:
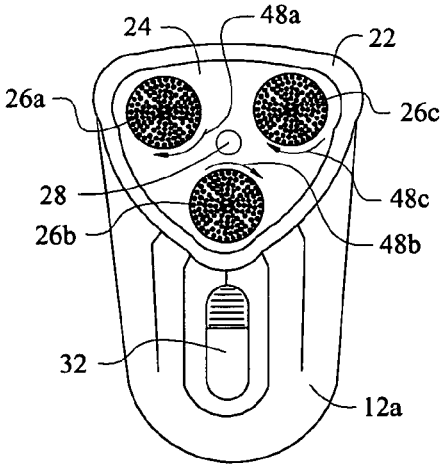
FIG. 21B is a top plan view of said twenty-first embodiment.

Embodiment number twenty-one is depicted in FIGS. 21A, 21B. It adds gel-applicator 34 (not depicted), conduit 38 (not depicted), and gel-applicator opening 40 to the eleventh embodiment of FIGS. 11A, 11B. Like the eleventh embodiment, this twenty-first embodiment includes no heater means.

Figure 22A:
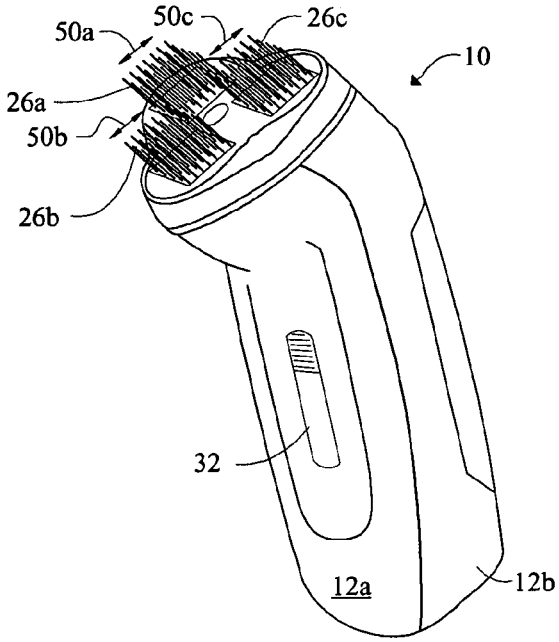
FIG. 22A is a perspective view of a twenty-second embodiment.
Figure 22B:
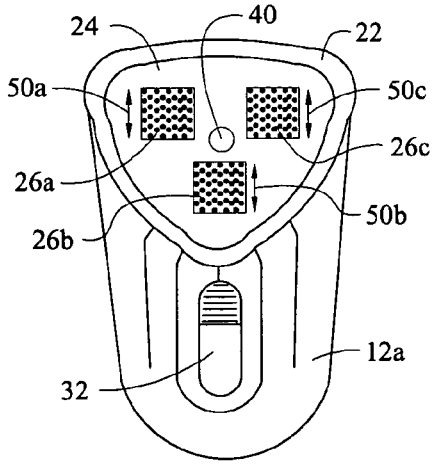
FIG. 22B is a top plan view of said twenty-second embodiment.

Embodiment number twenty-two is depicted in FIGS. 22A, 22B. It adds gel-applicator 34 (not depicted), conduit 38 (not depicted), and gel-applicator opening 40 to the twelfth embodiment of FIGS. 12A, 12B. Like the twelfth embodiment, this twenty-second embodiment includes no heater means.

Figure 23A:
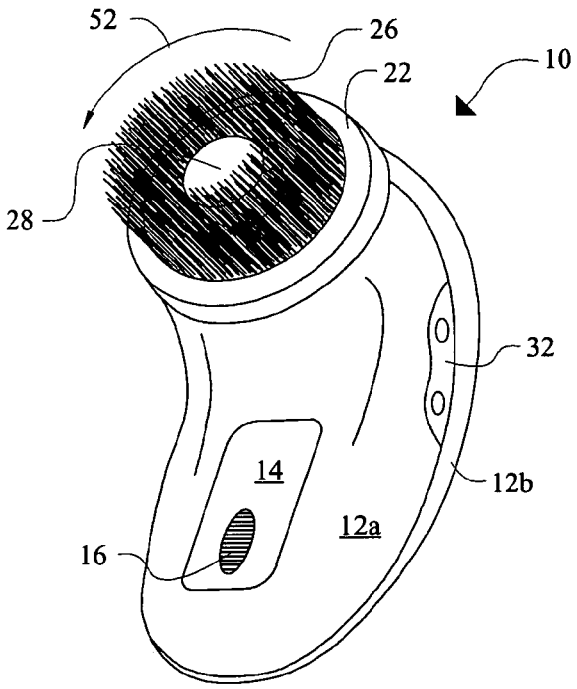
FIG. 23A is a perspective view of a twenty-third embodiment.
Figure 23B:
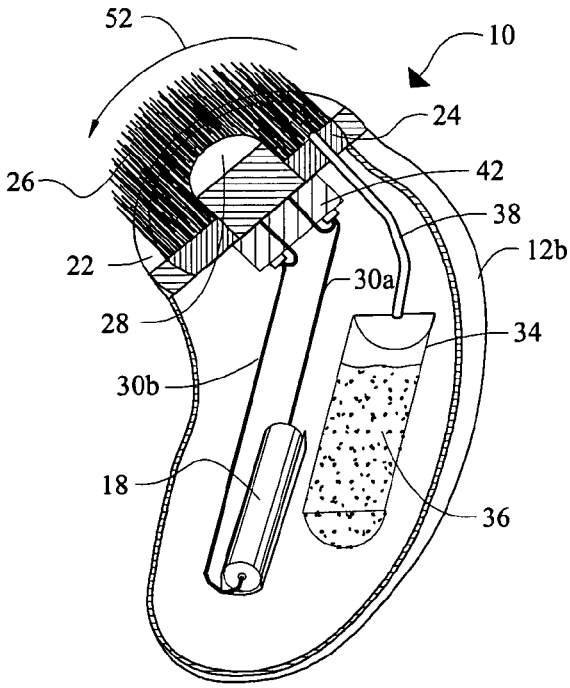
FIG. 23B is a perspective view of said twenty-third embodiment with a half shell of the main body thereof removed.
Figure 23C:
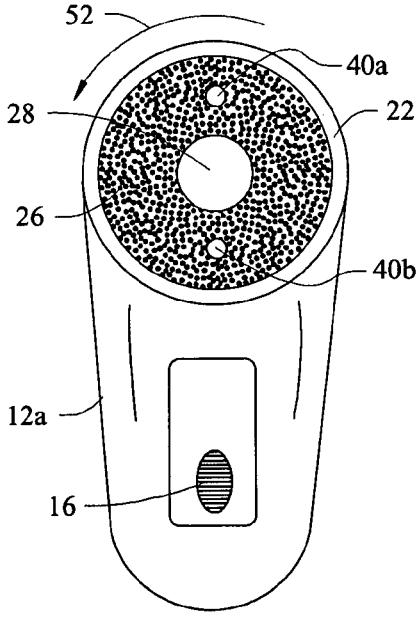
FIG. 23C is a top plan view of said twenty-third embodiment.

The twenty-third embodiment is depicted in FIGS. 23A, 23B, and 23C. It adds cartridge 34, conduit 38, and gel-applicator openings 40*a*, 40*b* to the thirteenth embodiment of FIGS. 13A, 13B.

Figure 24A:
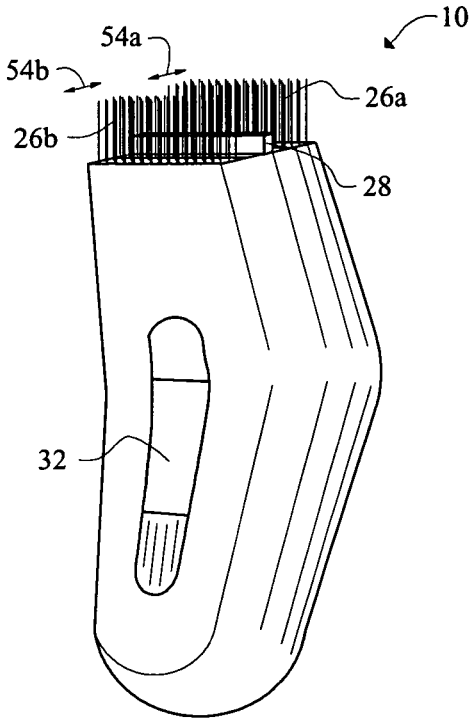
FIG. 24A is a perspective view of a twenty-fourth embodiment.
Figure 24B:
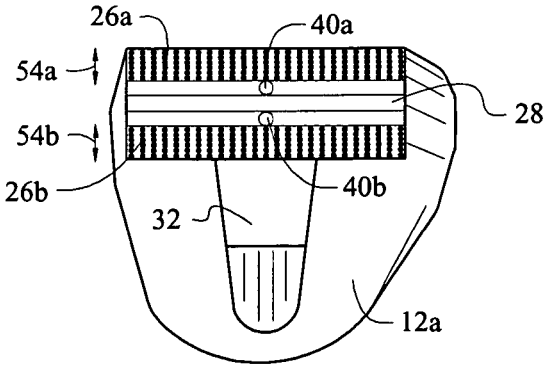
FIG. 24B is a top plan view of said twenty-fourth embodiment.

FIGS. 24A, 24B depict embodiment number twenty-four. This embodiment adds gel-applicator 34 (not depicted), conduit 38 (not depicted), and gel-applicator openings 40*a*, 40*b* to the fourteenth embodiment (FIGS. 14A, 14B).

Figure 25A:
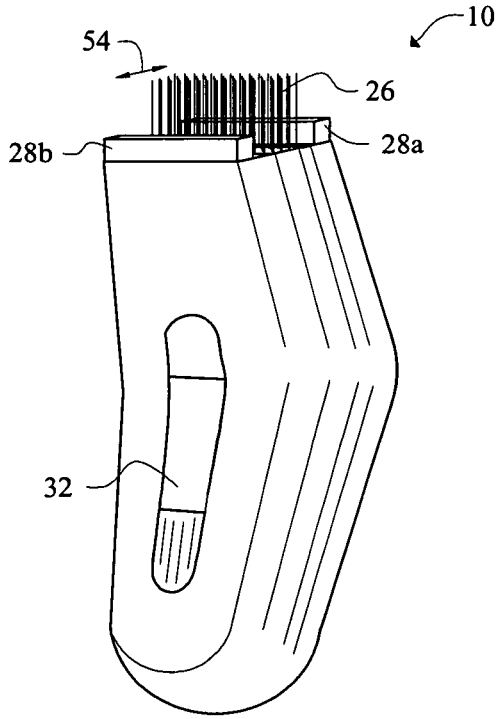
FIG. 25A is a perspective view of a twenty-fifth embodiment.
Figure 25B:
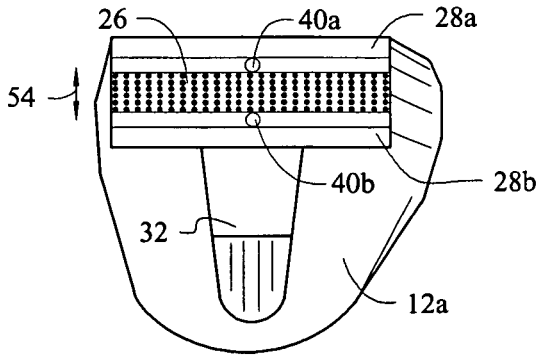
FIG. 25B is a top plan view of said twenty-fifth embodiment.

FIGS. 25A, 25B depict the twenty-fifth embodiment. This embodiment adds gel-applicator 34 (not depicted), conduit 38 (not depicted), and gel-applicator openings 40*a*, 40*b* to the fifteenth embodiment (FIGS. 15A, 15B).

Figure 26A:
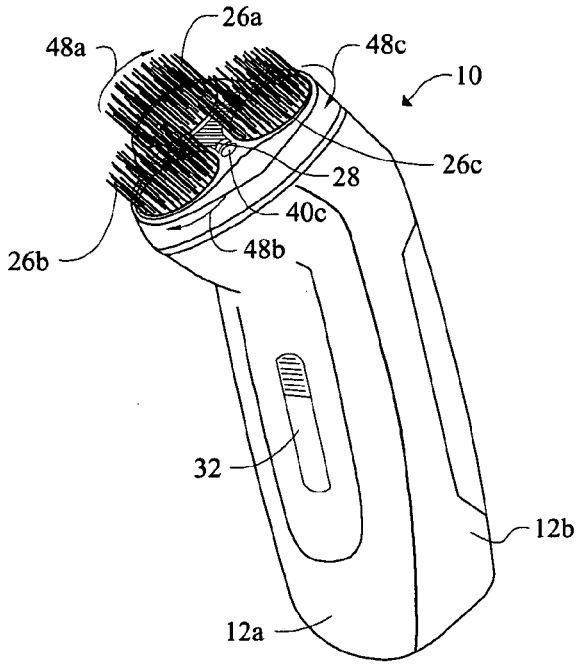
FIG. 26A is a perspective view of a twenty-sixth embodiment.
Figure 26B:
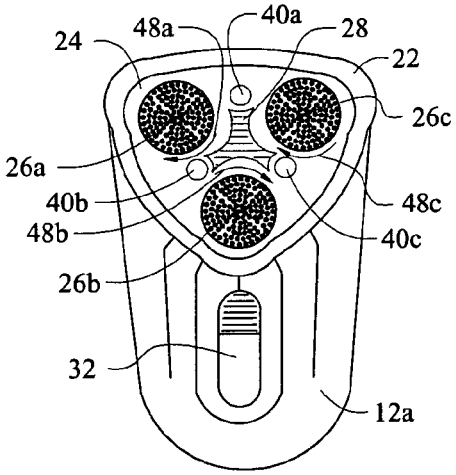
FIG. 26B is a top plan view of said twenty-sixth embodiment.

The embodiment of FIGS. 26A, 26B is the twenty-sixth embodiment. This embodiment adds gel-applicator 34 (not depicted), conduit 38 (not depicted), and gel-applicator openings 40*a*, 40*b*, 40*c* to the sixteenth embodiment (FIGS. 16A, 16B).

Figure 27A:
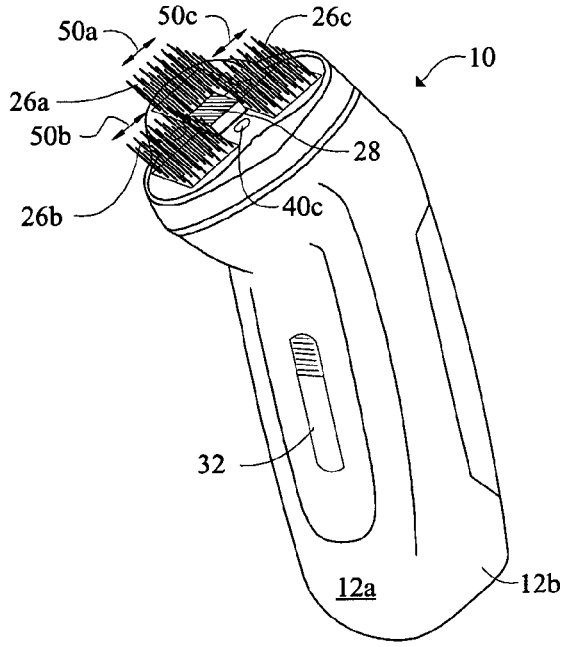
FIG. 27A is a perspective view of a twenty-seventh embodiment.
Figure 27B:
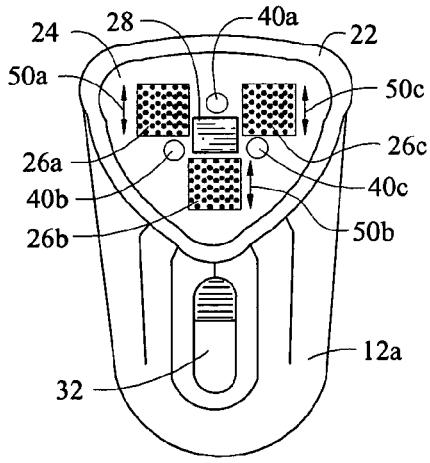
FIG. 27B is a top plan view of said twenty-seventh embodiment.

The embodiment of FIGS. 27A, 27B is the twenty-seventh embodiment. This embodiment adds gel-applicator 34 (not depicted), conduit 38 (not depicted), and gel-applicator openings 40*a*, 40*b*, 40*c* to the seventeenth embodiment (FIGS. 17A, 17B).

Figure 28A:
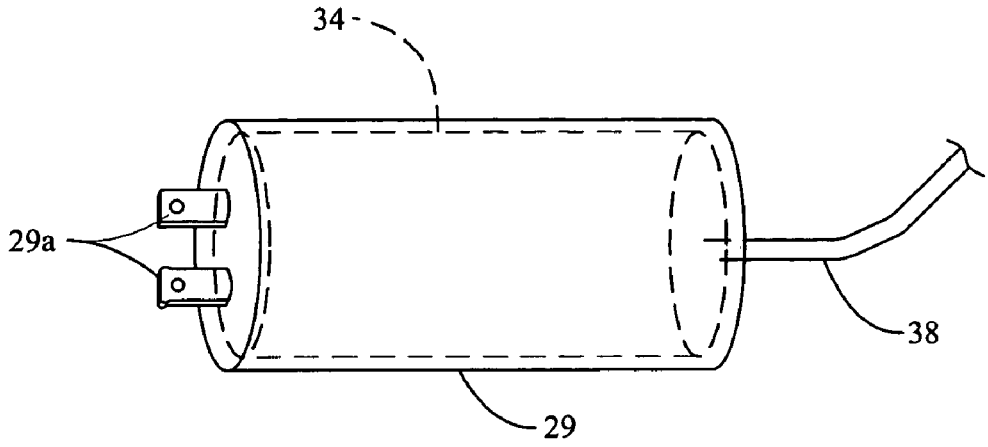
FIG. 28A is a perspective view of a gel pack and heater for a twenty-eighth embodiment.
Figure 28B:
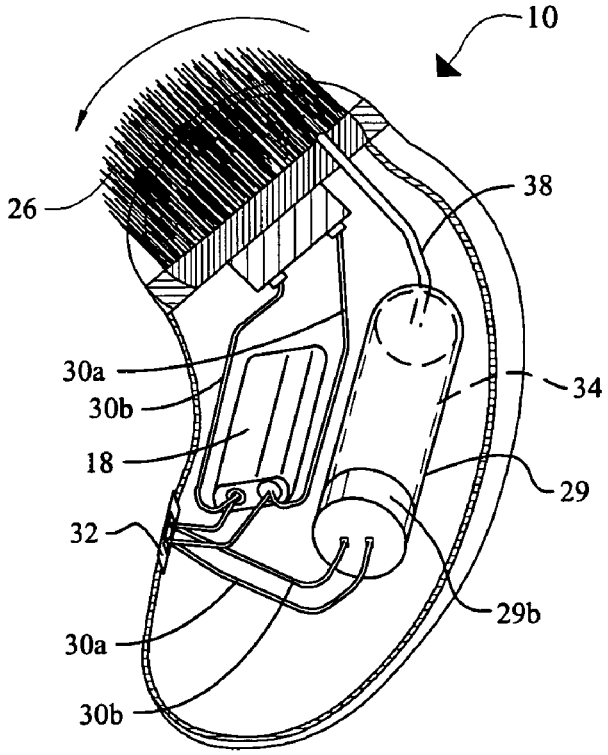
FIG. 28B is a perspective view of the twenty-eighth embodiment.

The twenty-eighth embodiment is depicted in FIGS. 28A and 28B. In this embodiment, gel 36 is heated within the hollow interior of applicator 10 instead of at a location near the brushes. This enhances the safety of the device by positioning the gel-heating means away from the user's skin. It also avoids dispensing cold gel that must be heated after it has been dispensed, while the brushes are rotating or reciprocating. Moreover, the gel remains warmer when heated in the gel pack. In the embodiment of FIGS. 28A and 28B, removable gel pack 34 is made of a suitable heat-conductive material. Removably-mounted heating unit 29 is a cylindrical housing that receives gel pack 34 therewithin. Such encapsulation of gel pack 34 ensures that gel 36 therewithin is heated evenly. A power source enables heating unit 29 to function with a switch 32 that controls temperature, or the temperature most suitable for a particular gel may be set automatically in the manner set forth in the fifth embodiment. Gel pack 34 is placed into removable heating unit 29 and said heating unit 29 is placed into the hollow interior of applicator 10. Electrical plugs 29*a*, 29*b* are received in electrical outlet 29*b* as indicated in FIG. 28B.

Figure 29A:
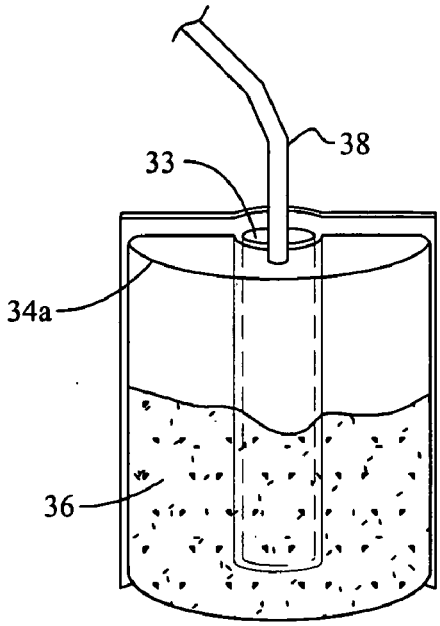
FIG. 29A is a perspective view of a gel pack and heater for a twenty-ninth embodiment.
Figure 29B:
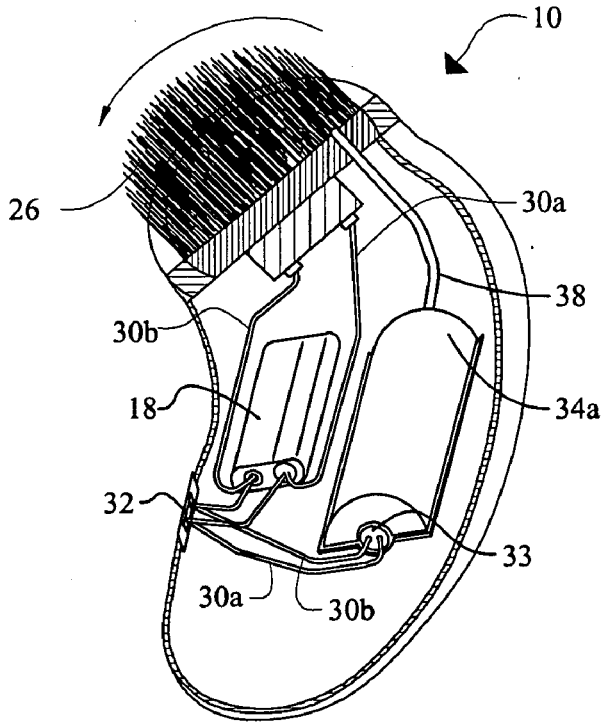
FIG. 29B is a perspective view of the twenty-ninth embodiment.

A twenty-ninth embodiment is depicted in FIGS. 29A and 29B. Gel pack 34 has a hemispherical construction so that it wraps half-way around heating rod 33. Gel pack 34 could also wrap completely around heating rod 33. As in the twenty-eighth embodiment, such construction enables removal of gel pack 34 while leaving heating rod 33 in place.

It will thus be seen that the objects set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

Now that the invention has been described,

The invention claimed is:

1. A shaving gel applicator, comprising: a hollow housing adapted to be gripped by a human hand; said housing having a closed distal end; said housing having an open proximal end; a base mounted in said open proximal end in closing relation to said open proximal end; said base defining at least one brush mounting surface area thereon and at least one heating means area extending therethrough; at least one brush of predetermined geometrical configuration mounted on said base in said at least one brush mounting surface area; at least one heating means of predetermined geometrical configuration mounted in said base in said at least one heating means area and positioned in heat-transfer relation to said at least one brush; a shaving gel cartridge disposed within said hollow interior of said hollow housing; at least one throughbore extending through said base exteriorly of said heating means area; said throughbore being located in fluid communication with said at least one brush; a conduit disposed in fluid communication between said shaving gel cartridge and said throughbore; a power source for heating said heating means; whereby heat generated by said heating means is transferred to shaving gel that is deposited upon said at least one brush; whereby said shaving gel is heated at the moment of application.

2. The shaving gel applicator of claim 1, wherein said power source for heating said heating means is disposed within a hollow interior of said housing.

3. The shaving gel applicator of 1, further comprising: a cartridge holder disposed within said hollow interior of said housing; said cartridge holder adapted to releasably receive said shaving gel cartridge.

4. The shaving gel applicator of claim 3, further comprising: said cartridge holder being adapted to slideably receive said shaving gel cartridge.

5. The shaving gel applicator of claim 3, further comprising: said cartridge holder adapted to screw-threadably receive said gel cartridge.

6. The shaving gel applicator of claim 3, further comprising: a cartridge detector disposed in said cartridge holder; said cartridge detector adapted to detect the presence of a cartridge in said cartridge holder, said cartridge detector adapted to identify, the type of cartridge in said cartridge holder; said cartridge detector being selected from a group of detectors consisting of mechanical, electrical, digital and wireless detectors.

7. The shaving gel applicator of claim 2, further comprising: a motor means disposed within said hollow interior of said hollow housing; said motor means having an output shaft to which is secured said heating means and said base so that said heating means and said brush rotate conjointly with said output shaft and; said motor means also powered by said power source.

8. The shaving gel applicator of claim 1, further comprising: said base being centrally apertured defining said at least one heating means area; said at least one brush mounting surface area being annular and surrounding said at least one heating means area; said at least one brush being a brush having an annular configuration and mounted on said annular brush mounting surface area; said at least one heating means being disposed in said central aperture, radially inward of said brush having said annular configuration, so that heat from said heating means is conducted radially outwardly to said brush having said annular configuration and to shaving gel deposited upon said brush having said annular configuration.

9. The shaving gel applicator of claim 1, further comprising: said base having a plurality of brush mounting surface areas; said at least one brush including a plurality of brushes mounted, respectively, on said brush mounting surface areas and disposed in circumferentially spaced relation relative to one another; said at least one heating means being disposed radially inwardly of said circumferentially spaced apart brushes so that heat from said heating means is conducted radially outwardly to said brushes and to shaving gel deposited upon said brushes.

10. The shaving gel applicator of claim 9, further comprising: each brush of said plurality of brushes being rotatably mounted with respect to said base; a motor means disposed within said hollow interior of said hollow housing; said motor means also powered by said power source; said motor means having an output shaft; a gear means for causing said at least one brush to rotate when said output shaft is rotating; said gear means disposed within said hollow interior.

11. The shaving gel applicator of claim 10, further comprising: said gear means including a sun gear mounted on said output shaft for conjoint rotation therewith; each brush of said plurality of brushes being mounted on an axle parallel to said output shaft; a planet gear mounted on each of said axles; each of said planet gears being disposed in meshing engagement with said sun gear so that rotation of said sun gear effects simultaneous and corresponding rotation of each of said planet gears and hence of each of said brushes of said plurality of brushes.

12. The shaving gel applicator of claim 1, further comprising: said at least one brush being mounted for linear reciprocation with respect to said base; a motor means disposed within said hollow interior of said hollow housing; said motor means also powered by said power source; said motor means having an output shaft; a linkage means that translates rotary motion to linear reciprocation so that said at least one brush reciprocates in a linear motion when said output shaft is rotating; said linkage means disposed within said hollow interior.

13. The shaving gel applicator of claim 1, further comprising: said predetermined geometrical configuration of said at least one brush being a disc shape.

14. The shaving gel applicator of claim 1, further comprising: said predetermined geometrical configuration of said at least one brush being a square shape.

15. The shaving gel applicator of claim 1, wherein said at least one brush mounting surface area includes two brush mounting surface areas; said at least one brush including two brushes mounted, respectively, on said base in said two brush mounting surface areas; said predetermined geometrical configuration of each brush of said two brushes being a rectangular shape; said at least one heating means having a straight configuration; said two brushes being disposed in parallel relation to one another on opposite sides of said heating means so that said heating means is disposed in sandwiched relation between said two rectangular brushes.

16. The shaving gel applicator of claim 15, further comprising: a motor means disposed in said hollow housing; said motor means also powered by said power source; said motor means adapted to cause linear reciprocation of said two rectangular brushes and said heating means.

* * * * *